US010131151B2

(12) United States Patent
Kamiya et al.

(10) Patent No.: US 10,131,151 B2
(45) **Date of Patent: *Nov. 20, 2018**

(54) INK CONTAINER WITH REFILL PORT AND SEALING MEMBER

(71) Applicant: BROTHER KOGYO KABUSHIKI KAISHA, Nagoya-shi, Aichi-ken (JP)

(72) Inventors: Masataka Kamiya, Owariasahi (JP); Seiji Shimizu, Ogaki (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/901,588

(22) Filed: Feb. 21, 2018

(65) Prior Publication Data

US 2018/0178529 A1 Jun. 28, 2018

Related U.S. Application Data

(63) Continuation of application No. 15/364,766, filed on Nov. 30, 2016, now Pat. No. 9,908,336.

(30) Foreign Application Priority Data

Dec. 2, 2015 (CN) ..... 2015 2 0984980 U

(51) Int. Cl.
*B41J 2/175* (2006.01)
*B41J 29/13* (2006.01)

(52) U.S. Cl.
CPC ..... *B41J 2/17506* (2013.01); *B41J 2/1752* (2013.01); *B41J 2/17509* (2013.01); *B41J 2/17523* (2013.01); *B41J 29/13* (2013.01)

(58) Field of Classification Search
CPC ..... B41J 2/17506; B41J 2/17556; B41J 2/17513; B41J 2/17553
See application file for complete search history.

(56) References Cited

U.S. PATENT DOCUMENTS

| | | | | |
|---|---|---|---|---|
| 9,079,413 | B2 | 7/2015 | Kudo et al. | |
| 9,908,336 | B2 * | 3/2018 | Kamiya | B41J 2/17506 |
| 2014/0043408 | A1 * | 2/2014 | Kudo | B41J 2/175 347/86 |
| 2016/0264306 | A1 * | 9/2016 | Nishimaki | B65D 41/005 |

FOREIGN PATENT DOCUMENTS

| | | |
|---|---|---|
| JP | 2014-046624 A | 3/2014 |

* cited by examiner

*Primary Examiner* — Henok Legesse
(74) *Attorney, Agent, or Firm* — Merchant & Gould P.C.

(57) ABSTRACT

An ink container for an inkjet printer includes an ink containing portion. The ink containing portion contains ink and includes an upper surface including a placing portion, a refill port disposed on the upper surface, and a sealing member. The sealing member includes a sealing portion located at the center and an outer peripheral portion located at the outer periphery. An outer diameter of the sealing portion matches with an inner diameter of the refill port. The placing portion further includes a first recess portion and a positioning portion extending in a circumferential direction of the first recess portion. The first recess portion is configured to receive the sealing member and not to contact the sealing portion. The positioning portion includes a restricting portion configured to reduce horizontal movement of the outer peripheral portion and a supporting portion configured to vertically support the outer peripheral portion.

11 Claims, 17 Drawing Sheets

INK CONTAINER WITH REFILL PORT AND SEALING MEMBER

CROSS-REFERENCE TO RELATED APPLICATION

This application is a continuation of U.S. patent application Ser. No. 15/364,766, filed Nov. 30, 2016, which further claims priority from Chinese Utility Model Application No. 201520984980.3, filed on Dec. 2, 2015, both of which are incorporated herein by reference in their entirety.

TECHNICAL FIELD

The disclosure relates to an ink container and an inkjet printer including an ink container.

BACKGROUND

Known inkjet printers, as depicted in FIG. 1, typically include a printer body 20 and an ink container 10 that is fixed to a side surface of the printer body 20. The ink container 10 includes a frame portion 12 and a cover 11 pivotable between a closed position (as shown in FIG. 1) and an opened position (as shown in FIG. 2) with respect to the frame portion 12. The ink container 10, as depicted in FIG. 3, includes an ink containing portion 16, on which a refill port 15 through which ink is poured into the ink containing portion 16 is formed. The refill port 15 is provided with a sealing member 30, and before pouring ink, the user may remove the sealing member 30 to make an access to the refill port 15 and may place it on a placing portion 40.

The conventional placing portion, as depicted in FIGS. 4A and 4B, includes a recess portion 42 and a projecting portion 41 which protrudes upward in a central portion of the recess portion 42. The conventional sealing member, as depicted in FIGS. 5A and 5B, includes a sealing portion 34. The projecting portion 41 is configured to be inserted into a hole 34a of the sealing portion 34 to position the sealing member 30.

When pouring ink into the ink containing portion 16, the ink is easily adhered to the refill port 15. As a result, the sealing member 30 and the placing portion 40 may be also contaminated with the ink adhered to the refill port 15.

SUMMARY

The present disclosure describes an ink container that may reduce contamination with the ink adhered to the refill port.

According to an aspect of the disclosure, an ink container for an inkjet printer may include an ink containing portion. The inkjet printer may include a printer body. The ink containing portion may be configured to contain ink to be supplied to the printer body and include an upper surface, a refill port, and a sealing member. The upper surface may include a placing portion. The refill port may be disposed on the upper surface, and ink is poured through the refill port. The placing portion may be disposed corresponding to the refill port. The sealing member may include a sealing portion located at the center and an outer peripheral portion located at the outer periphery. An outer diameter of the sealing portion may match with an inner diameter of the refill port. The placing portion further may include a first recess portion and a positioning portion extending in a circumferential direction of the first recess portion. The first recess portion may be configured to receive the sealing member and not to contact the sealing portion. The positioning portion may include a restricting portion configured to reduce horizontal movement of the outer peripheral portion and a supporting portion configured to vertically support the outer peripheral portion.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

For a more complete understanding of the present disclosure, needs satisfied thereby, and the objects, features, and advantages thereof, reference now is made to the following descriptions taken in connection with the accompanying drawings. Hereinafter, illustrative embodiments of the disclosure will be described in detail with reference to the accompanying drawings. The terms "front", "back", "left", "right", "top" and "bottom" are used herein for the purpose of illustration and not of limitation. The terms "first" and "second" referenced herein are merely identification and do not have any other meaning, such as a particular order. For example, the term "first component" does not imply the presence of "second component", and the term "second component" does not imply the presence of "first component". The term "parallel" and "perpendicular" referenced herein means substantially "parallel" and "perpendicular".

The inkjet printer according to the disclosure may have various functions such as an image scanner function, a facsimile function and a copier function, in addition to a printing function. The printing function may include a double-sided image recording function capable of recording an image on both side of a recording sheet.

Figure 1:
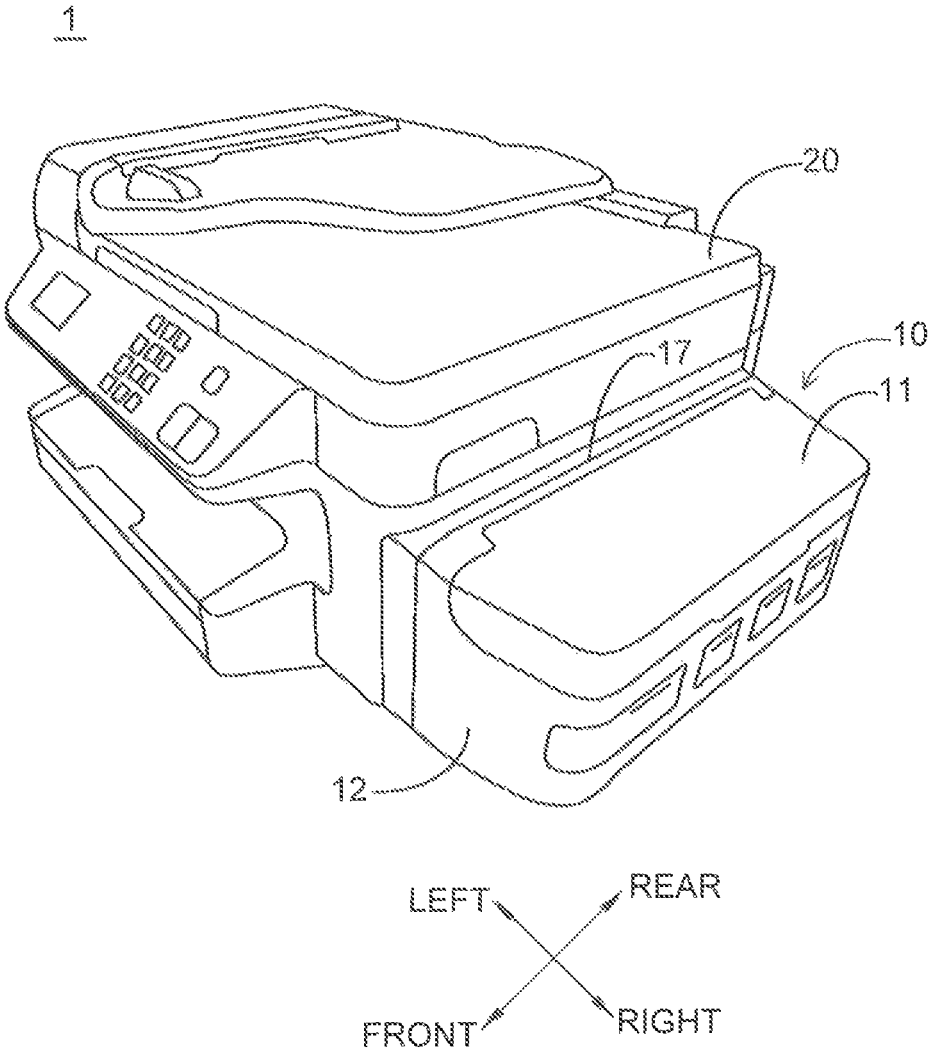
FIG. 1 is a perspective view depicting a conventional inkjet printer, in which the cover is in the closed position.
Figure 2:
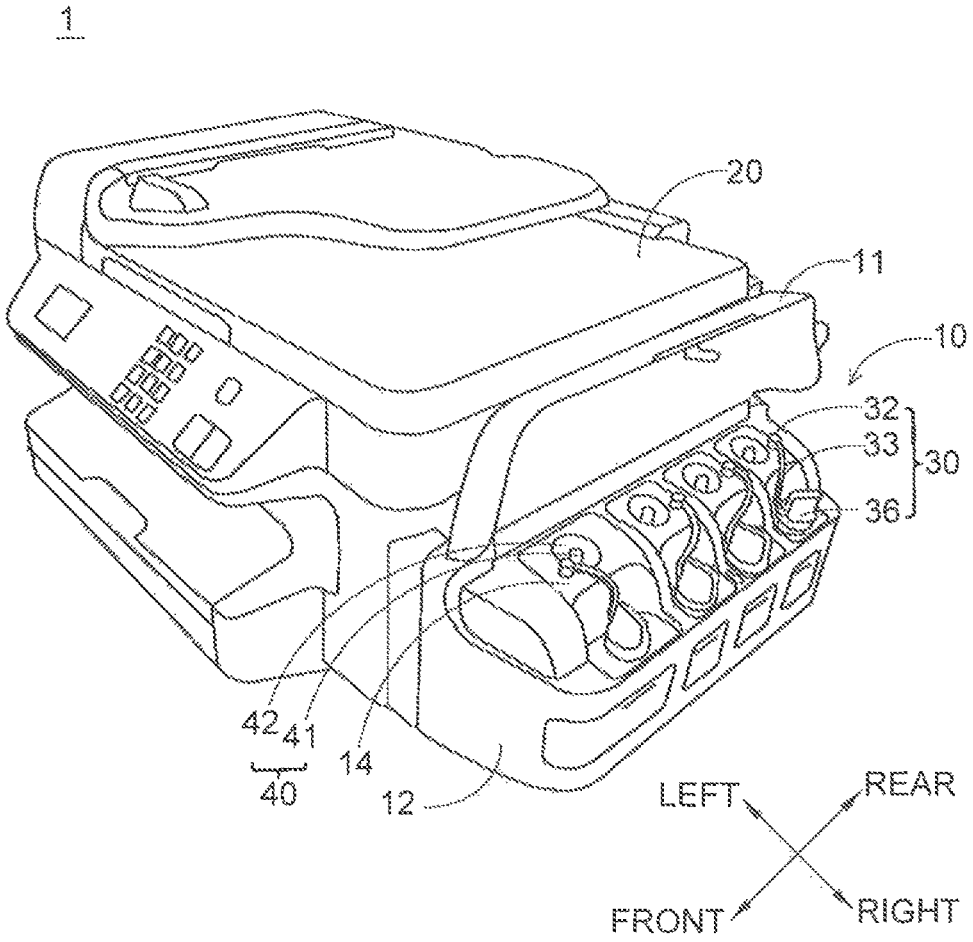
FIG. 2 is a perspective view depicting the inkjet printer of FIG. 1, in which the cover is in the opened position.
Figure 3:
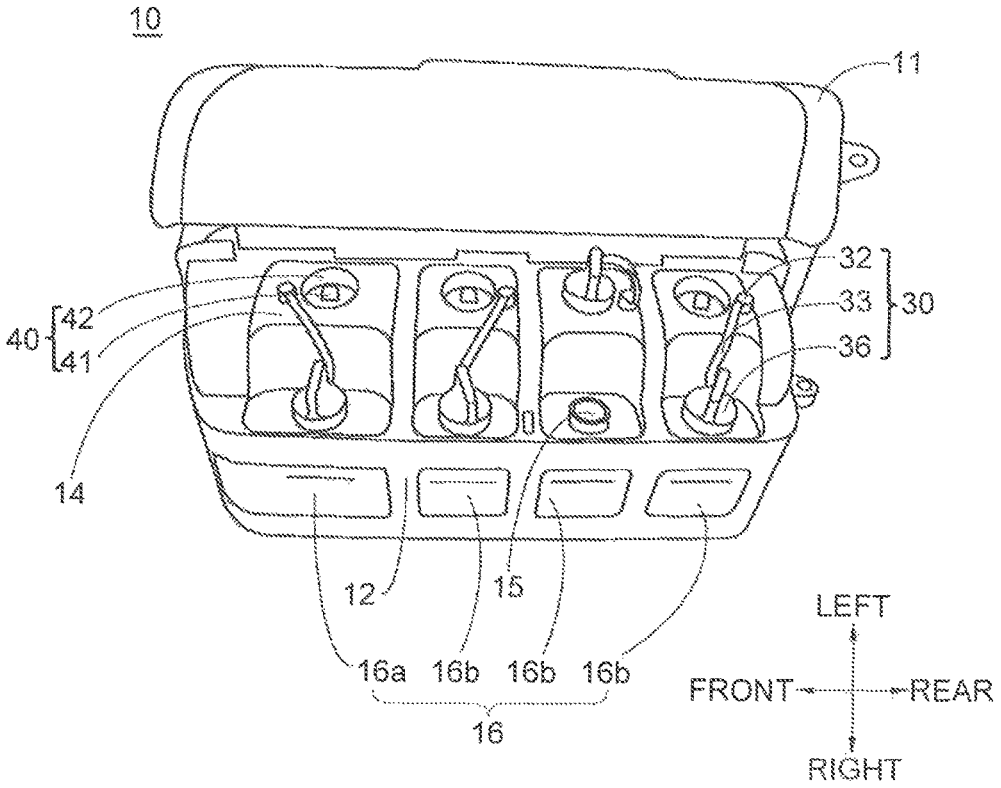
FIG. 3 is a perspective view depicting an ink container of the inkjet printer of FIG. 1, in which the cover is in the opened position.
Figure 4A:
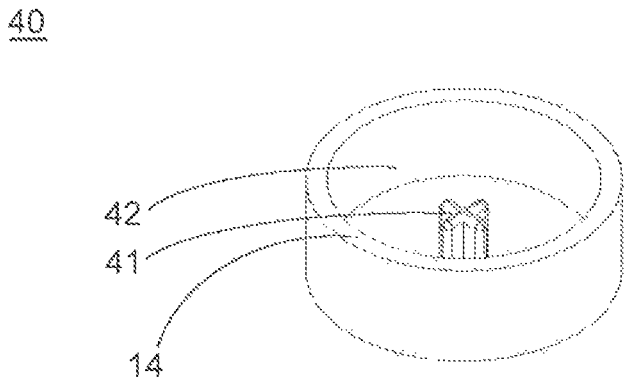
FIG. 4A is a perspective view depicting a conventional placing portion.
Figure 4B:
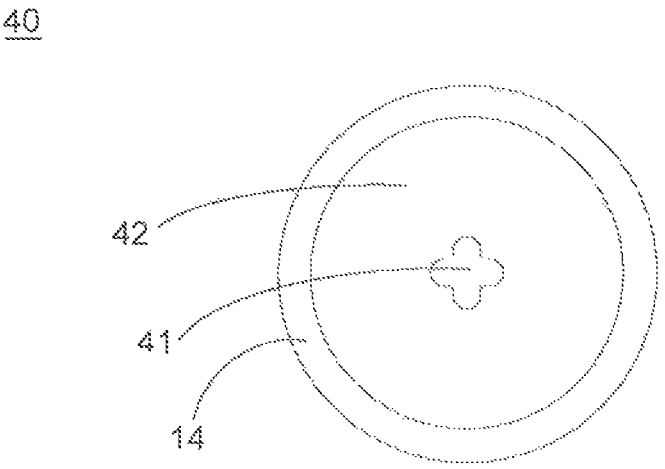
FIG. 4B is a plan view depicting the placing portion of FIG. 4A.

As depicted in FIGS. 1-3, the inkjet printer 1 includes a printer body 20 and an ink container 10. The ink container 10 is fixed to or detachably attached to the printer body 20. The printer body 20 has a substantially rectangular parallelepiped shape. The ink container 10 is disposed on an attaching surface 17, which is a right side surface of the printer body 20, and extends rightward from the right side surface of the printer body 20. It should be appreciated that although the ink container 10 is disposed on the right side of the printer body 20 in the illustrated embodiment, the ink container 10 may be fixed or detachably attached to other portions of the printer body 20, according to the actual needs.

The ink container 10 includes a frame portion 12, a cover 11, and an ink containing portion 16. The ink containing portion 16 is disposed inside the frame portion 12 and is configured to contain ink to be supplied to the printer body 20. The ink containing portion 16 includes a first ink containing portion 16*a* and a plurality of second ink containing portions 16b. Each of the plurality of second ink containing portions 16*b* is smaller than the first ink containing portion 16*a*, and is successively disposed behind the first ink containing portion 16*a*. The ink container 10 includes four ink containing portions 16, each of which is configured to contain ink of different colors, for example, the first ink containing portion 16*a* is configured to contain black ink, and each of three of second ink containing portions 16*b* is configured to contain cyan ink, magenta ink, and yellow ink, respectively. The ink container 10 may include six, eight, or twelve ink containing portions to record the color image using six, eight, or twelve colors of ink, respectively.

As depicted in FIG. 3, each of the ink containing portions includes a refill port 15 through which allows the user to pour ink into the ink containing portion 16. The refill port 15 includes a sealing member 30 configured to seal the refill port 15. The refill port 15 typically has a cylindrical shape, which protrudes from an upper surface of the ink containing portion 16 and has an opening opened upward.

The ink container 10 further includes a cover 11. The cover 11 has a substantially plate shape and has a downwardly-extending side wall at the front end, the right end and the rear end. The cover 11 is connected to the frame portion 12 such that the cover 11 is pivotable about a pivot axis. The pivot axis is parallel to the attaching surface 17, to which the ink container 10 is attached, of the printer body 11 and extends along a horizontal direction. In other words, the pivot axis extends along a front-rear direction of the ink container 10. Specifically, the cover 11 is pivotable between a closed position and an opened position with respect to the frame portion 12. When the cover 11 is in the closed position, the cover 11 covers the refill port 15. When the cover 11 is in the opened position, the refill port 15 is exposed. The user may pour ink in the refill port 15 after pivoting the cover 11 from the closed position to the opened position to expose the refill port 15.

Figure 5A:
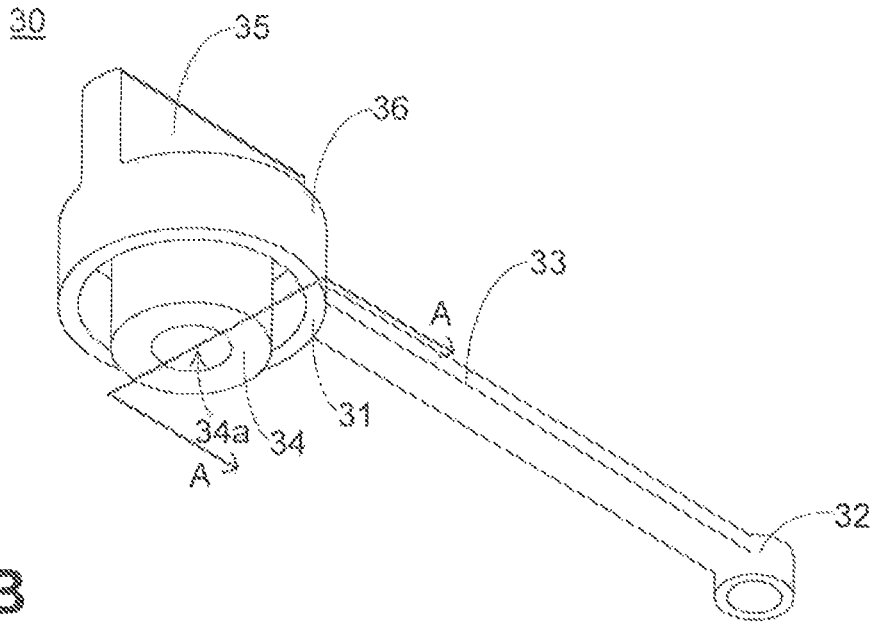
FIG. 5A is a perspective view depicting a conventional sealing member.
Figure 5B:
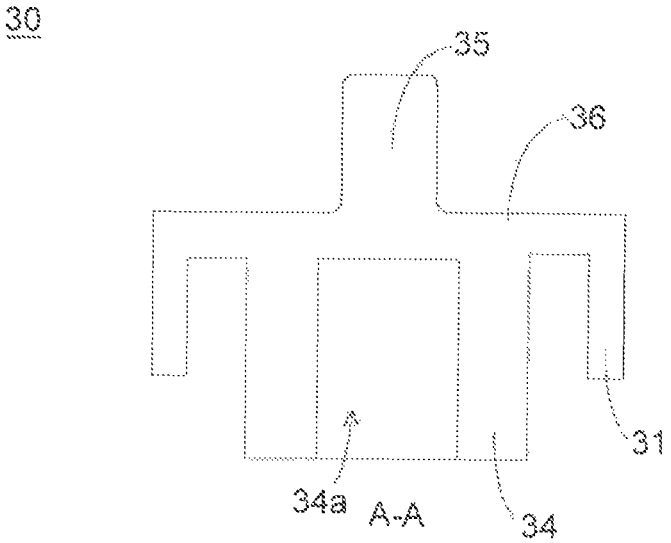
FIG. 5B is a sectional view of the sealing member taken along a line A-A in FIG. 5A.

As depicted in FIGS. 5A and 5B, the sealing member 30 includes a main body portion 36 and a protruding portion 35. The main body portion 36 is shaped to cap and fit the refill port 15 to seal the refill port 15. For ease of user operation, the main body portion 36 generally has a rotationally symmetrical shape. The main body portion 36 includes a sealing portion 34 and an outer peripheral portion 31. The sealing portion 34 is configured to be inserted into the refill port 15 and may have a hollow cylindrical shape. The outer diameter of the sealing portion 34 is slightly larger than the inner diameter of the refill port 15. The outer peripheral portion 31 may also have a hollow cylindrical shape. The inner diameter of the cylindrical portion of the outer peripheral portion 31 is slightly larger than the outer diameter of the refill port 15. Thus, when the sealing member 30 is in a sealing position where the sealing portion 34 of the sealing member 30 is closely fitted on the refill port 15 so that ink does not spill out from the refill port 15, the refill port 15 is sealed by elastic deformation of the sealing portion 34. According to this state, it may be said that the outer diameter of the sealing portion 34 matches with the inner diameter of the refill port 15.

The protruding portion 35 is disposed on an upper surface of the main body portion 36 and protrudes from the upper surface of the main body portion 36. The user can hold the protruding portion 35 with his/her fingers to operate the sealing member 30.

Further, the sealing member 30 may include a connecting portion 33 and a fixed portion 32. The connecting portion 33 may connect the main body portion 36 and the fixed portion 32. The fixed portion 32 is anchored to the frame portion 12 of the ink container 10 so that the entire sealing member 30 may not be separated from the frame portion 12 of the ink container 10 when the main body portion 36 is removed from the refill port 15. The connecting portion 33 may have a flat ribbon shape and a rectangular cross section. The fixed portion 32 may have a cylindrical shape with a recess at the bottom. The recess may be engaged with a projection provided on the frame portion 12, thereby detachably attaching the sealing member 30 to the frame portion 12.

The frame portion 12 includes placing portions 40, each of which corresponds to the refill port 15 one by one. The placing portion 40 is configured to receive the sealing member 30 of the main body portion 36 and is disposed on an upper surface of the frame portion 12. Thus, the main body portion 36 removed from the refill port 15 may be placed on the placing portion 40 such that ink drop may not fall on the surrounding of the ink container 10, thereby reducing contamination of the surrounding environment.

First Embodiment

Figure 6A:
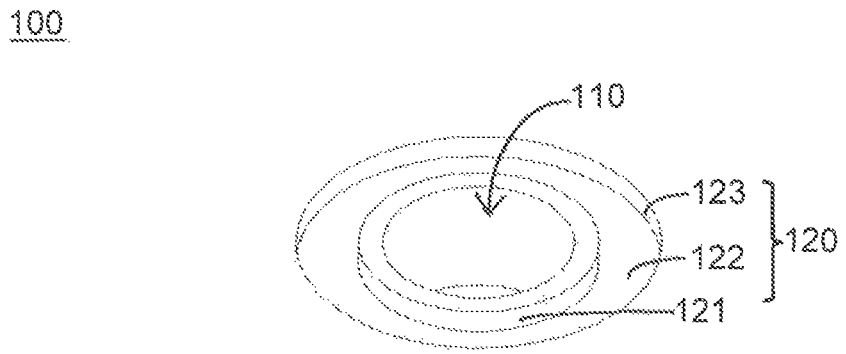
FIG. 6A is a perspective view depicting a placing portion in a first embodiment according to one or more aspects of the disclosure.
Figure 6B:
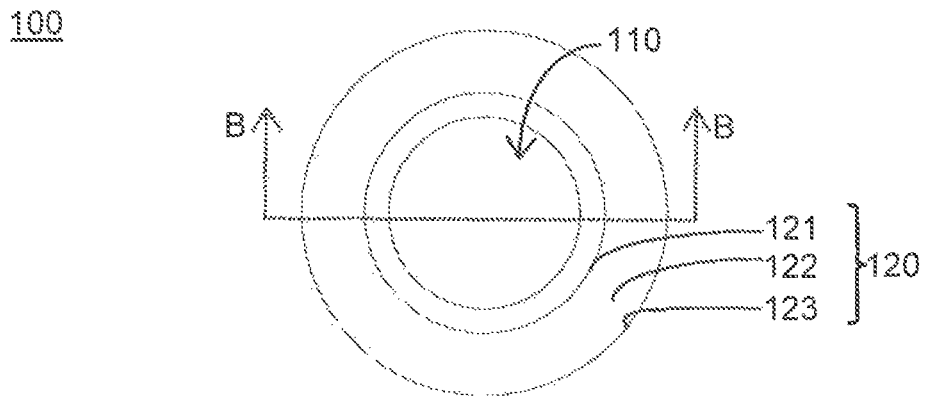
FIG. 6B is a plan view depicting the placing portion of FIG. 6A.
Figure 6C:
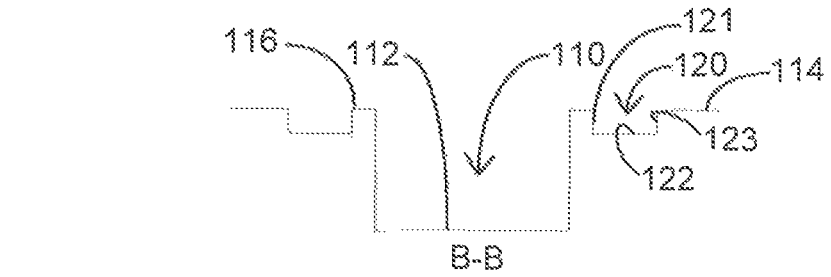
FIG. 6C is a sectional view of the placing portion taken along a line B-B in FIG. 6B.

FIGS. 6A-6C depict a placing portion 100 in a first embodiment according to the disclosure. The placing portion 100 includes a first recess portion 110 and a second recess portion 120 extending in a circumferential direction of the first recess portion 110. The second recess portion 120 is an example of a positioning member.

The first recess portion 110 is configured to accommodate the sealing portion 34 of the sealing member 30 and not to contact the sealing portion 34 while accommodating the sealing portion 34. The first recess portion 110 may be configured to be a cylindrical recess.

The second recess portion 120 includes a bottom portion 122, and a first side wall 121 and a second side wall 123 which extend upward along the bottom portion 122. The bottom portion 122 of the second recess portion 120 is higher than a bottom portion 112 of the first recess portion 110.

An upper surface 114 of the frame portion 12 may be higher than the bottom portion 122 of the second recess portion 120.

Figure 6D:
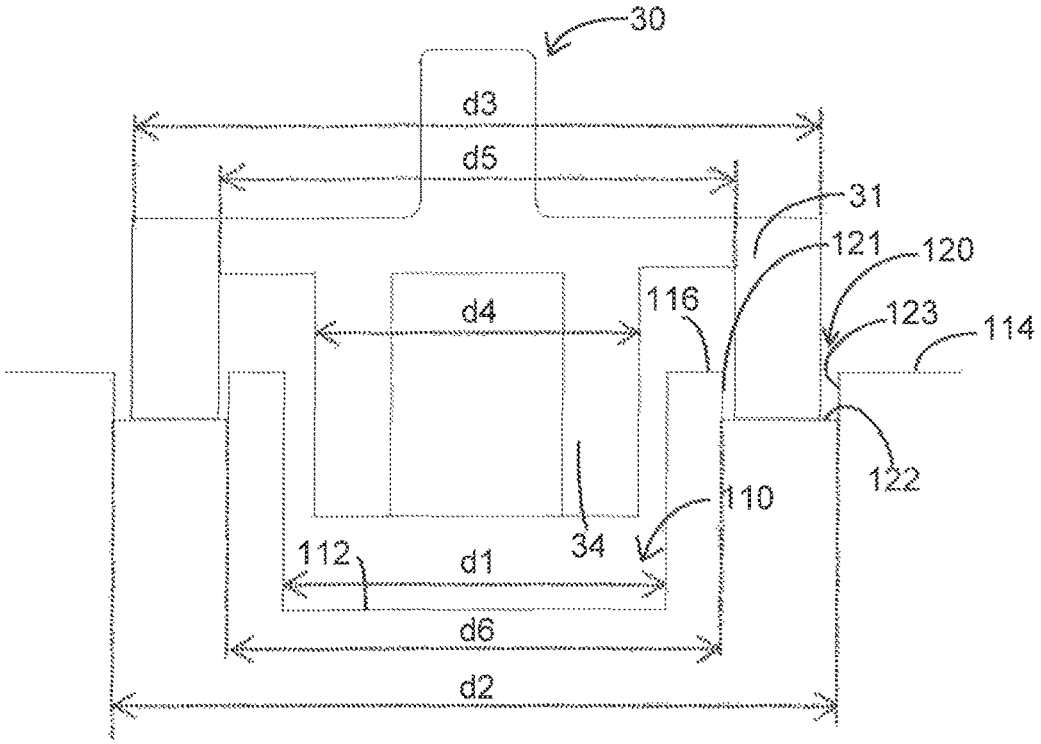
FIG. 6D is a sectional view of the placing portion taken along a line B-B in FIG. 6B, illustrating the sealing member.

As depicted in FIG. 6D, the first side wall 121 and the second side wall 123 of the second recess portion 120 are examples of a restricting portion, which is configured to restrict or reduce horizontal movement of the outer peripheral portion 31 by a certain amount. The bottom portion 122 of the second recess portion 120 is an example of a supporting portion, which is configured to vertically support the outer peripheral portion 31.

Further, the bottom portion 122 of the second recess portion 120 is lower than a top portion 116 of the first recess portion 110.

Contamination of the placing portion 100 may be avoided by preventing the sealing portion 34 from coming into contact with an inner wall of the first recess portion 110. If it is defined that the inner diameter of the first recess portion 110 is d1, the maximum inner diameter of the second recess portion 120 is d2, the outer diameter of the outer peripheral portion 31 is d3, the outer diameter of the sealing portion 34 is d4, the inner diameter of the outer peripheral portion 31 is d5, and the outer diameter of the first side wall 121 is d6, the following relationship is satisfied:

$$(d1-d4)>(d2-d3)\geq 0;\ \text{and}$$

$$(d1-d4)>(d5-d6)\geq 0.$$

Figure 6E:
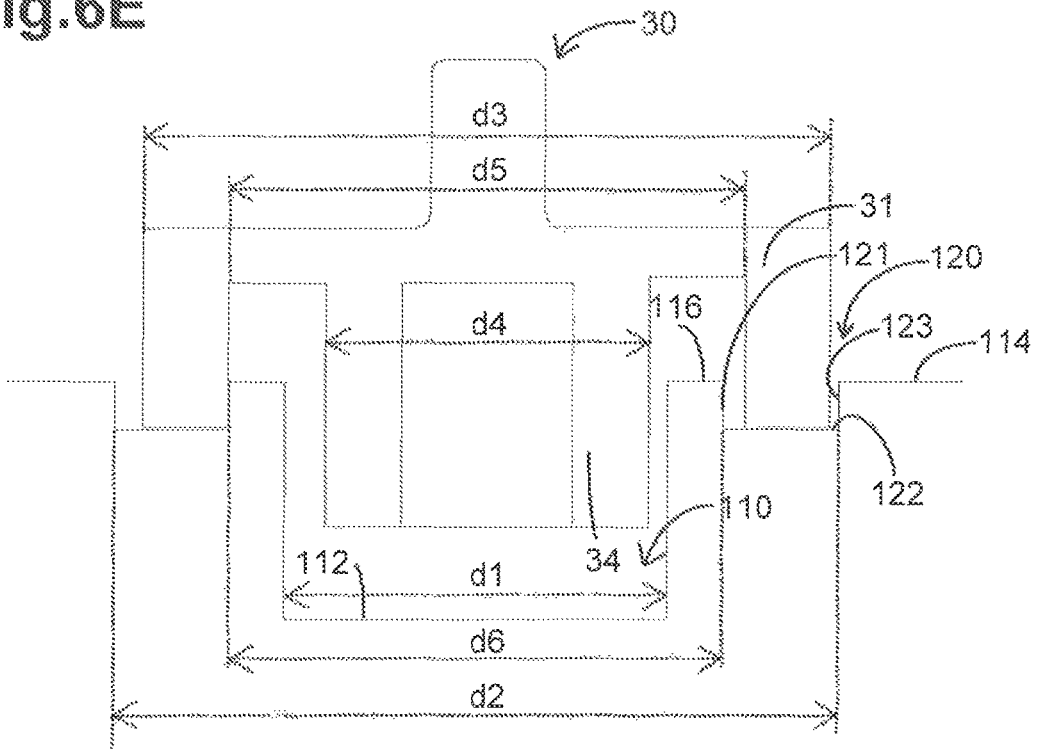
FIG. 6E is a sectional view of the placing portion taken along a line B-B in FIG. 6B, illustrating the sealing member contacting the placing portion.

As depicted in FIGS. 6D and 6E, "d1−d4", i.e., a difference between the inner diameter of the first recess portion 110 and the outer diameter of the sealing portion 34, may be considered a distance range in which the sealing portion 34 is movable in the horizontal direction within the first recess portion 110. "(d1−d4)>0" may be set to ensure that the sealing portion 34 does not come into contact with the inner wall of the first recess portion 110.

Similarly, "d2−d3", i.e., a difference between the maximum inner diameter of the second recess portion 120 and the outer diameter of the outer peripheral portion 31, may be considered a distance range in which an outer surface of the outer peripheral portion 31 is movable in the horizontal direction within the second recess portion 120. It is desirable that, even when the outer surface of the outer peripheral portion 31 comes into contact with the second side wall 123 in the horizontal direction within the second recess portion 120, i.e., d2 is equal to d3 (d2−d3=0), the sealing portion 34 does not contact the inner wall of the first recess portion 110, i.e., (d1−d4)>0. In other words, when the outer surface of the outer peripheral portion 31 comes into contact with the second side wall 123 in the horizontal direction within the second recess portion 120, there is still a certain distance between the sealing portion 34 and the inner wall of the first recess portion 110. Thus, the difference, d1−d4, between the inner diameter of the first recess portion 110 and the outer diameter of the sealing portion 34 is set to be larger than the difference, d2−d3, between the maximum inner diameter of the second recess portion 120 and the outer diameter of the outer peripheral portion 31, i.e., (d1−d4)>(d2−d3)≥0.

Furthermore, "d5−d6", i.e., a difference between the inner diameter of the outer peripheral portion 31 and the outer diameter of the first side wall 121, may be considered a distance range in which an inner surface of the outer peripheral portion 31 is movable in the horizontal direction within the second recess portion 120. It is desirable that, even when the inner surface of the outer peripheral portion 31 comes into contact with the first side wall 121 in the horizontal direction within the second recess portion 120, i.e., d5 is equal to d6 (d5−d6=0), the sealing portion 34 does not contact the inner wall of the first recess portion 110, i.e., (d1−d4)>0. In other words, when the inner surface of the outer peripheral portion 31 comes into contact with the first side wall 121 in the horizontal direction within the second recess portion 120, there is still a certain distance between the sealing portion 34 and the inner wall of the first recess portion 110. Thus, the difference, d1−d4, between the inner diameter of the first recess portion 110 and the outer diameter of the sealing portion 34 is set to be larger than the difference, d5−d6, between the inner diameter of the outer peripheral portion 31 and the outer diameter of the first side wall 121, i.e., (d1−d4)>(d5−d6)≥0.

According to the ink container of the first embodiment, the placing portion does not come into contact with the sealing portion of the sealing member, so that contamination of the placing portion with the ink adhering to the sealing portion may be prevented or reduced. Further, horizontal movement of the sealing member is restricted or reduced by the restricting portion, so that it may be easier to place the sealing member on the placing portion. Furthermore, the bottom portion of the second recess portion supports the outer peripheral portion, and the second recess portion may restrict or reduce horizontal movement of the sealing member.

Second Embodiment

Figure 7A:
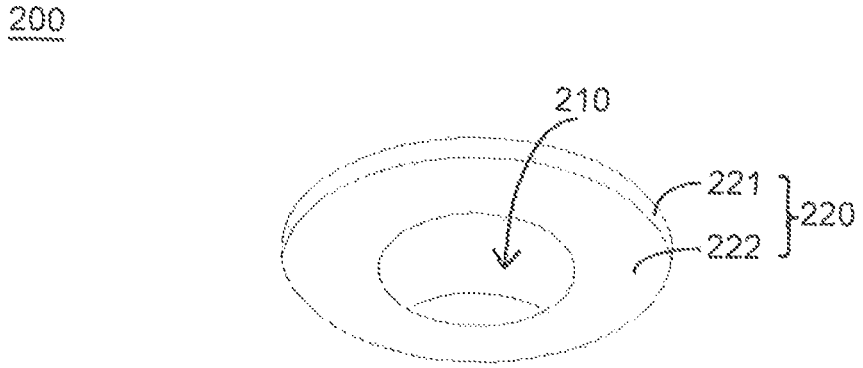
FIG. 7A is a perspective view depicting a placing portion in a second embodiment according to one or more aspects of the disclosure.
Figure 7B:
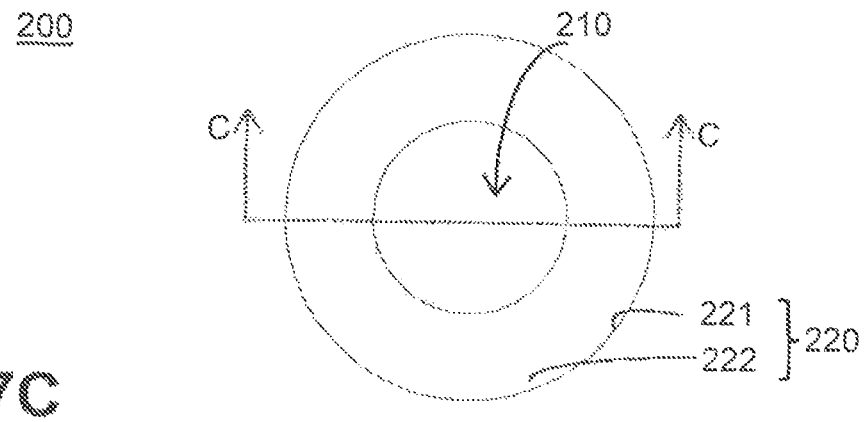
FIG. 7B is a plan view depicting the placing portion of FIG. 7A.
Figure 7C:
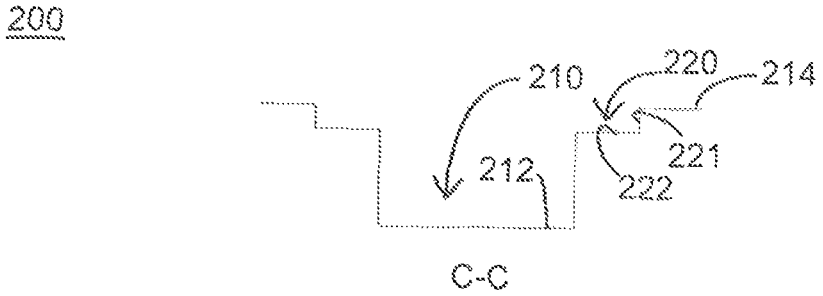
FIG. 7C is a sectional view of the placing portion taken along a line C-C in FIG. 7B.

FIGS. 7A-7C depict a placing portion 200 in a second embodiment according to the disclosure. In the illustrated embodiment, the reference numerals are matched in the first embodiment and the second embodiment, except that the first digit is changed from 1 to 2.

The placing portion 200 includes a first recess portion 210 and a second recess portion 220 extending in a circumferential direction of the first recess portion 210. The second recess portion 220 is an example of a positioning member.

The first recess portion 210 is configured to accommodate the sealing portion 34 of the sealing member 30 and not to contact the sealing portion 34 while accommodating the sealing portion 34. The first recess portion 210 may be configured to be a cylindrical recess.

The second recess portion 220 includes a bottom portion 222 and a side wall 221 which extends upward along the bottom portion 222. The bottom portion 222 of the second recess portion 220 is higher than a bottom portion 212 of the first recess portion 210. Unlike the first embodiment, the bottom portion 222 of the second recess portion 220 is on the same level as the top portion of the first recess portion 210. Thus, the second recess portion 220 includes only one side wall 221, which is positioned outside.

An upper surface 214 of the frame portion 12 may be higher than the bottom portion 222 of the second recess portion 220.

Figure 7D:
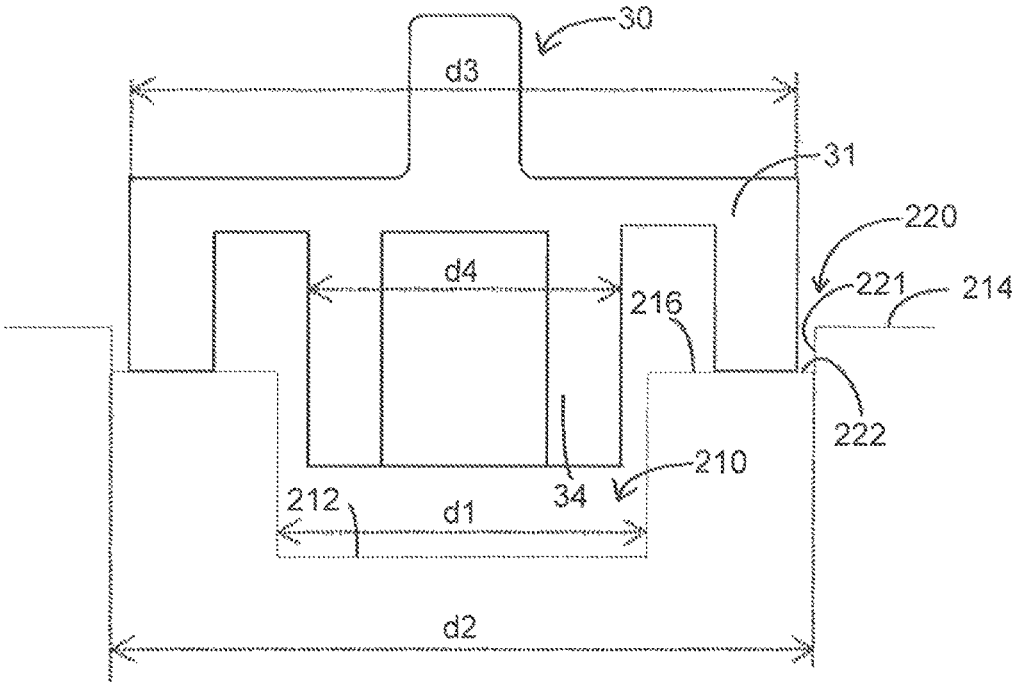
FIG. 7D is a sectional view of the placing portion taken along a line C-C in FIG. 7B, illustrating the sealing member.

As depicted in FIG. 7D, the side wall 221 of the second recess portion 220 is an example of a restricting portion, which is configured to restrict or reduce horizontal movement of the outer peripheral portion 31 by a certain amount. The bottom portion 222 of the second recess portion 220 is an example of a supporting portion, which is configured to vertically support the outer peripheral portion 31.

If it is defined that the inner diameter of the first recess portion 210 is d1, the maximum inner diameter of the second recess portion 220 is d2, the outer diameter of the outer peripheral portion 31 is d3, and the outer diameter of the sealing portion 34 is d4, the following relationship is satisfied:

$$(d1-d4)>(d2-d3)\geq 0.$$

Figure 7E:
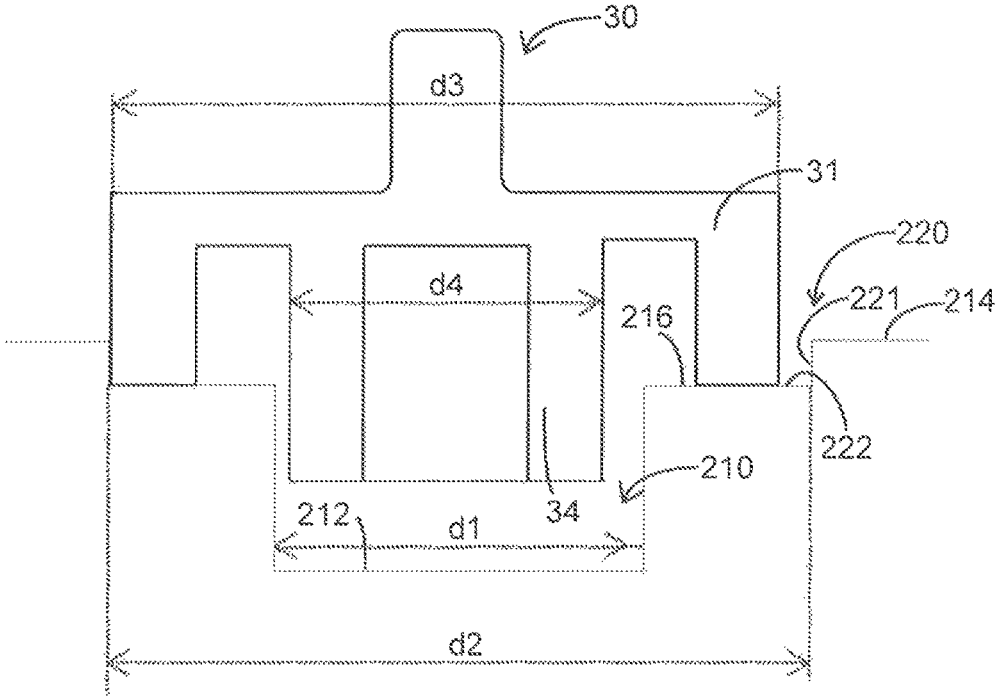
FIG. 7E is a sectional view of the placing portion taken along a line C-C in FIG. 7B, illustrating the sealing member contacting the placing portion.

As depicted in FIG. 7E, "d1−d4", i.e., a difference between the inner diameter of the first recess portion 210 and the outer diameter of the sealing portion 34, may be considered a distance range in which the sealing portion 34 is movable in the horizontal direction within the first recess portion 210. "(d1−d4)>0" may be set to ensure that the sealing portion 34 does not come into contact with the inner wall of the first recess portion 210.

Similarly, "d2−d3", i.e., a difference between the maximum inner diameter of the second recess portion 220 and the outer diameter of the outer peripheral portion 31, may be considered a distance range in which an outer surface of the outer peripheral portion 31 is movable in the horizontal direction within the second recess portion 220. It is desirable that, even when the outer surface of the outer peripheral portion 31 comes into contact with the side wall 221 of the second recess portion 220 in the horizontal direction within the second recess portion 220, i.e., d2 is equal to d3 (d2−d3=0), the sealing portion 34 does not contact the inner wall of the first recess portion 210, i.e., (d1−d4)>0. In other words, when the outer surface of the outer peripheral portion 31 comes into contact with the side wall 221 of the second recess portion 220 in the horizontal direction within the second recess portion 220, there is still a certain distance between the sealing portion 34 and the inner wall of the first recess portion 210. Thus, the difference, d1−d4, between the inner diameter of the first recess portion 210 and the outer diameter of the sealing portion 34 is set to be larger than the difference, d2−d3, between the maximum inner diameter of the second recess portion 220 and the outer diameter of the outer peripheral portion 31, i.e., (d1−d4)>(d2−d3)≥0.

According to the ink container of the second embodiment, the bottom portion of the second recess portion is on the same level as the top portion of the first recess portion, so that the structure of the placing portion may be simple and the manufacturing cost may be reduced. The bottom portion of the second recess portion supports the outer peripheral portion, and the second recess portion may restrict or reduce horizontal movement of the sealing member radially outwardly.

Third Embodiment

Figure 8A:
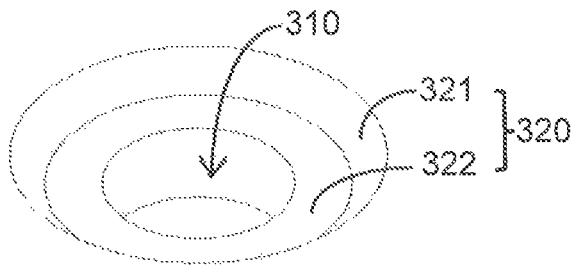
FIG. 8A is a perspective view depicting a placing portion in a third embodiment according to one or more aspects of the disclosure.
Figure 8B:
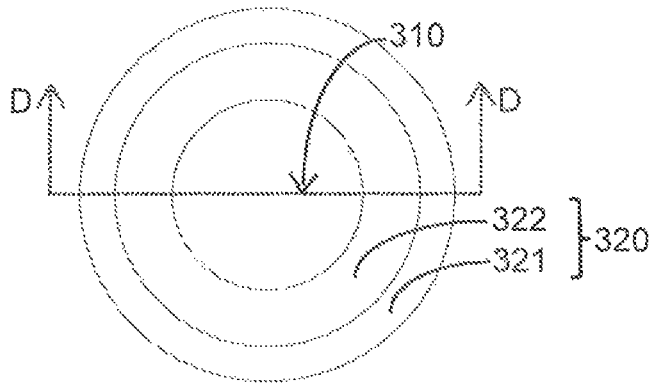
FIG. 8B is a plan view depicting the placing portion of FIG. 8A.
Figure 8C:
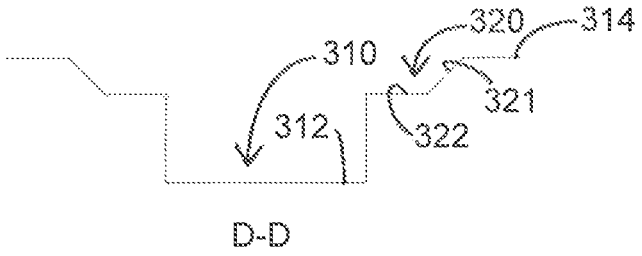
FIG. 8C is a sectional view of the placing portion taken along a line D-D in FIG. 8B.

FIGS. 8A-8C depict a placing portion 300 in a third embodiment according to the disclosure. In the illustrated embodiment, the reference numerals are matched in the second embodiment and the third embodiment, except that the first digit is changed from 2 to 3.

The placing portion 300 includes a first recess portion 310 and a second recess portion 320 extending in a circumferential direction of the first recess portion 310. The second recess portion 320 is an example of a positioning member.

The first recess portion 310 is configured to accommodate the sealing portion 34 of the sealing member 30 and not to contact the sealing portion 34 while accommodating the sealing portion 34. The first recess portion 310 may be configured to be a cylindrical recess.

The second recess portion 320 includes a bottom portion 322 and a side wall 321 which extends upward along the bottom portion 322. The bottom portion 322 of the second recess portion 320 is higher than a bottom portion 312 of the first recess portion 310. Unlike the second embodiment, the side wall 321 is inclined outwardly. This configuration may allow the side wall 321 to function as a guide.

An upper surface 314 of the frame portion 12 is higher than the bottom portion 322 of the second recess portion 320 and is connected to an upper end of the side wall 321.

The side wall 321 of the second recess portion 320 is an example of a restricting portion, which is configured to restrict or reduce horizontal movement of the outer peripheral portion 31 by a certain amount. The bottom portion 322 of the second recess portion 320 is an example of a supporting portion, which is configured to vertically support the outer peripheral portion 31.

If it is defined that the inner diameter of the first recess portion 310 is d1, the maximum inner diameter of the second recess portion 320, i.e., the maximum outer diameter of the bottom portion 322 of the second recess portion 320, is d2, the outer diameter of the outer peripheral portion 31 is d3, and the outer diameter of the sealing portion 34 is d4, the following relationship is satisfied:

$$(d1-d4)>(d2-d3)\geq 0.$$

According to the ink container of the third embodiment, the inclined side wall may function as a guide, so that it may be easier to place the sealing member on the placing portion.

Fourth Embodiment

Figure 9A:
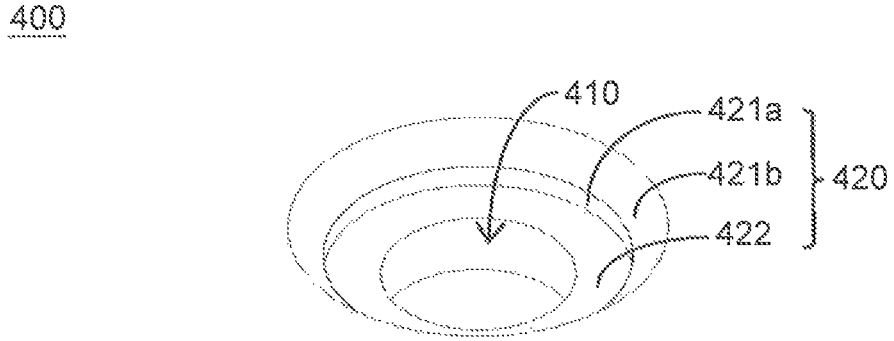
FIG. 9A is a perspective view depicting a placing portion in a fourth embodiment according to one or more aspects of the disclosure.
Figure 9B:
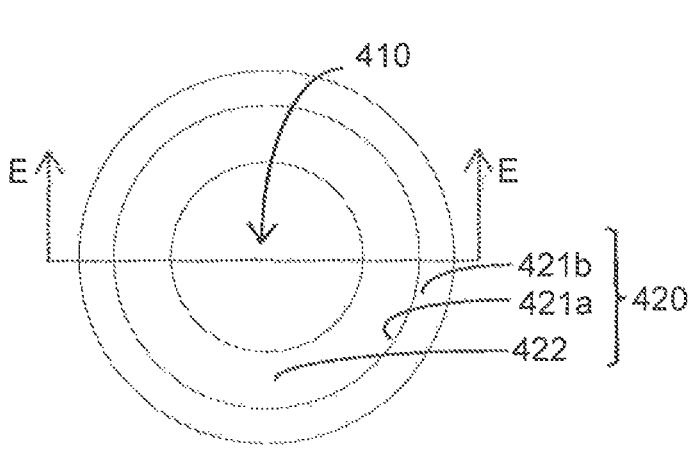
FIG. 9B is a plan view depicting the placing portion of FIG. 9A.
Figure 9C:
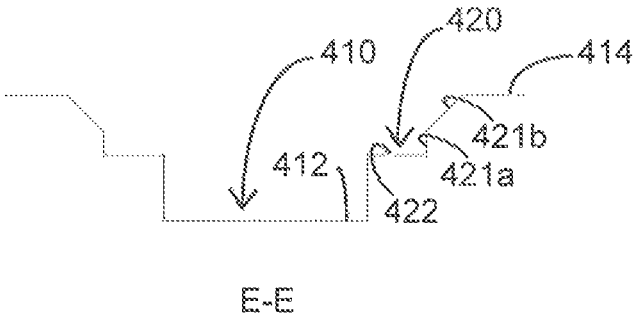
FIG. 9C is a sectional view of the placing portion taken along a line E-E in FIG. 9B.

FIGS. 9A-9C depict a placing portion 400 in a fourth embodiment according to the disclosure. In the illustrated embodiment, the reference numerals are matched in the second embodiment and the fourth embodiment, except that the first digit is changed from 2 to 4.

The placing portion 400 includes a first recess portion 410 and a second recess portion 420 extending in a circumferential direction of the first recess portion 410. The second recess portion 420 is an example of a positioning member.

The first recess portion 410 is configured to accommodate the sealing portion 34 of the sealing member 30 and not to contact the sealing portion 34 while accommodating the sealing portion 34. The first recess portion 410 may be configured to be a cylindrical recess.

The second recess portion 420 includes a bottom portion 422, and a side wall 421*a*, 421*b* which extend upward along the bottom portion 422. The bottom portion 422 of the second recess portion 420 is higher than a bottom portion 412 of the first recess portion 410. The bottom portion 422 of the second recess portion 420 is on the same level as the top portion of the first recess portion 410. The side wall 421*a*, 421*b* of the second recess portion 420 is positioned outside.

Further, the side wall 421*a*, 421*b* includes a first vertical wall 421*a* and an inclined wall 421*b*. The first vertical wall 421*a* is connected to the bottom portion 422 of the second recess portion 420 and is perpendicular to the bottom portion 422 of the second recess portion 420. The inclined wall 421*b* is connected to an upper end of the first vertical wall 421*a* and is inclined outwardly.

An upper surface 414 of the frame portion 12 is higher than the bottom portion 422 of the second recess portion 420 and is connected to an upper end of the inclined wall 421*b*.

The first vertical wall 421*a* of the second recess portion 420 is an example of a restricting portion, which is configured to restrict or reduce horizontal movement of the outer peripheral portion 31 by a certain amount. The bottom portion 422 of the second recess portion 420 is an example of a supporting portion, which is configured to vertically support the outer peripheral portion 31.

If it is defined that the inner diameter of the first recess portion 410 is d1, the maximum inner diameter of the second recess portion 420, i.e., the maximum inner diameter of the first vertical wall 421*a* of the second recess portion 420, is d2, the outer diameter of the outer peripheral portion 31 is d3, and the outer diameter of the sealing portion 34 is d4, the following relationship is satisfied:

$$(d1-d4)>(d2-d3)\geq 0.$$

According to the ink container of the fourth embodiment, the first vertical wall may better abut against the outer surface of the outer peripheral portion, and the inclined side wall may function as a guide, so that it may be easier to place the sealing member on the placing portion.

Fifth Embodiment

Figure 10A:
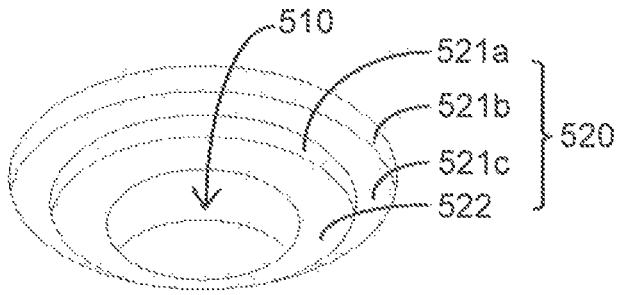
FIG. 10A is a perspective view depicting a placing portion in a fifth embodiment according to one or more aspects of the disclosure.
Figure 10B:
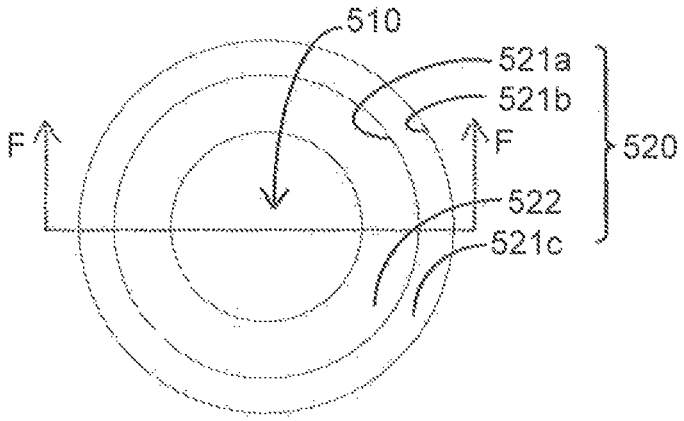
FIG. 10B is a plan view depicting the placing portion of FIG. 10A.
Figure 10C:
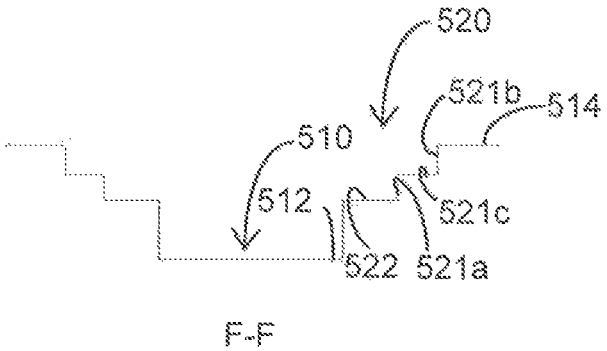
FIG. 10C is a sectional view of the placing portion taken along a line F-F in FIG. 10B.

FIGS. 10A-10C depict a placing portion 500 in a fifth embodiment according to the disclosure. In the illustrated embodiment, the reference numerals are matched in the first embodiment and the fifth embodiment, except that the first digit is changed from 1 to 5.

The placing portion 500 includes a first recess portion 510 and a second recess portion 520 extending in a circumferential direction of the first recess portion 510. The second recess portion 520 is an example of a positioning member.

The first recess portion 510 is configured to accommodate the sealing portion 34 of the sealing member 30 and not to contact the sealing portion 34 while accommodating the sealing portion 34. The first recess portion 510 may be configured to be a cylindrical recess.

The second recess portion 520 includes a bottom portion 522, and a side wall 521*a*, 521*b* which extend upward along the bottom portion 522. The bottom portion 522 of the second recess portion 520 is higher than a bottom portion 512 of the first recess portion 510. The bottom portion 522 of the second recess portion 520 is on the same level as the top portion of the first recess portion 510. The side wall 521*a*, 521*b* of the second recess portion 420 is positioned outside.

Further, the side wall 521*a*, 521*b* includes a first vertical wall 521*a* and a second vertical wall 521*b*. The first vertical wall 521*a* and the second vertical wall 521*b* are connected by a horizontal portion 521*c* extending from an upper end of the first vertical wall 521*a* to a lower end of the second vertical wall 521*b* in the horizontal direction. The first vertical wall 521*a* is connected to the bottom portion 522 of the second recess portion 520 and is perpendicular to the bottom portion 522 of the second recess portion 520. The second vertical wall 521*b* extends vertically upward from the outermost end of the horizontal portion 521*c*.

An upper surface 514 of the frame portion 12 is higher than the bottom portion 522 of the second recess portion 520 and is connected to an upper end of the second vertical wall 521*b*.

The first vertical wall 521*a* of the second recess portion 520 is an example of a restricting portion, which is configured to restrict or reduce horizontal movement of the outer peripheral portion 31 by a certain amount. The bottom portion 522 of the second recess portion 520 is an example of a supporting portion, which is configured to vertically support the outer peripheral portion 31.

If it is defined that the inner diameter of the first recess portion 510 is d1, the maximum inner diameter of the second recess portion 520 is d2, the outer diameter of the outer peripheral portion 31 is d3, and the outer diameter of the sealing portion 34 is d4, the following relationship is satisfied:

$$(d1-d4)>(d2-d3)\geq 0.$$

According to the ink container of the fifth embodiment, the first vertical wall may better abut against the outer surface of the outer peripheral portion, and the horizontal portion and the second vertical wall may function as a guide, so that it may be easier to place the sealing member on the placing portion.

Furthermore, in the above-described first to fifth embodiments, the side wall may not be continuous, that is, the side walls divided into a plurality of portions may be arranged with a space therebetween. Such configuration may provide not only the above-described technical effects but also the design diversity, and enable the user to place the sealing member on the space.

Sixth Embodiment

Figure 11A:
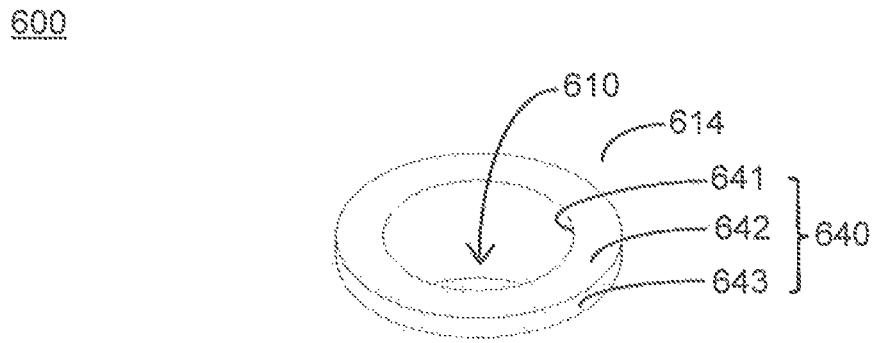
FIG. 11A is a perspective view depicting a placing portion in a sixth embodiment according to one or more aspects of the disclosure.
Figure 11B:
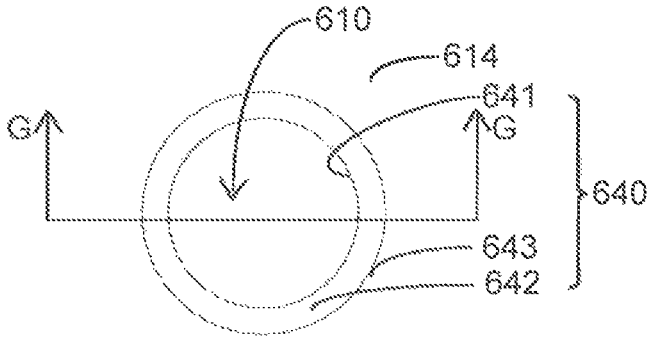
FIG. 11B is a plan view depicting the placing portion of FIG. 11A.
Figure 11C:
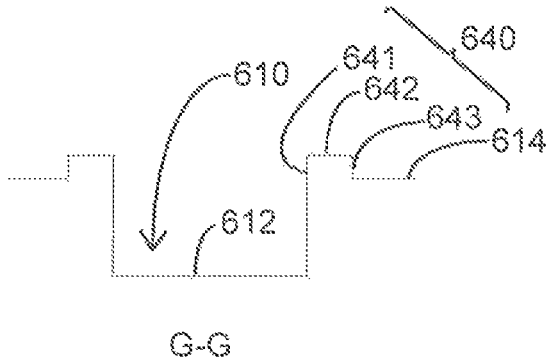
FIG. 11C is a sectional view of the placing portion taken along a line G-G in FIG. 11B.

FIGS. 11A-11C depict a placing portion 600 in a sixth embodiment according to the disclosure. In the illustrated embodiment, the reference numerals are matched in the first embodiment and the fifth embodiment, except that the first digit is changed from 1 to 6.

The placing portion 600 includes a first recess portion 610 and a protruding part 640 extending in a circumferential direction of the first recess portion 610. The protruding part 640 is an example of a positioning member.

The first recess portion 610 is configured to accommodate the sealing portion 34 of the sealing member 30 and not to contact the sealing portion 34 while accommodating the sealing portion 34. The first recess portion 610 may be configured to be a cylindrical recess.

Figure 11D:
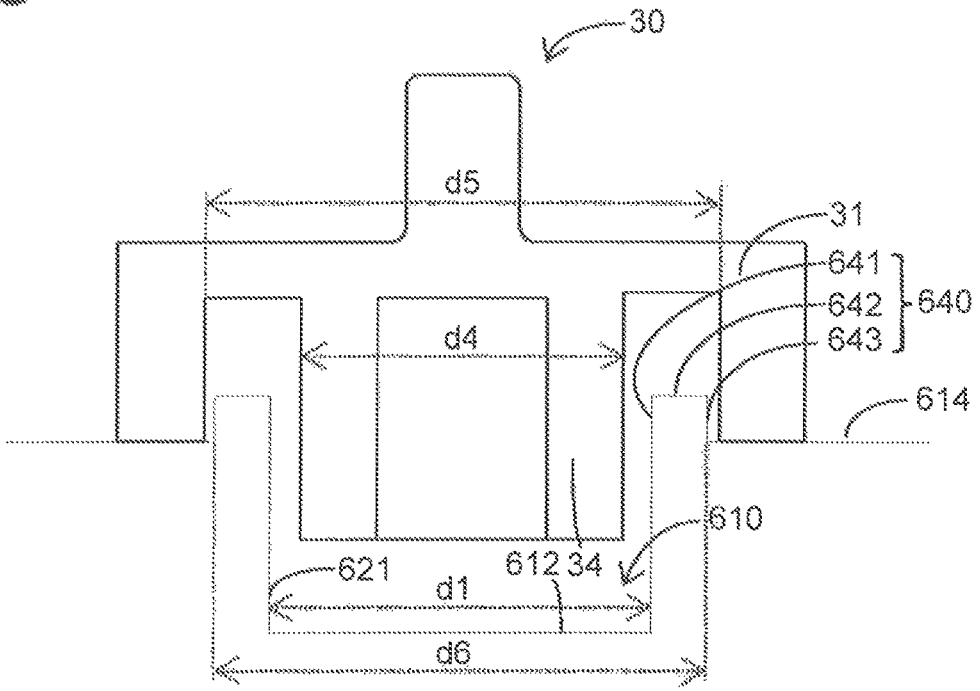
FIG. 11D is a sectional view of the placing portion taken along a line G-G in FIG. 11B, illustrating the sealing member.

As depicted in FIG. 11D, the protruding part 640 protruding upward with respect to an upper surface 614 of the placing portion 600 is an example of a restricting portion, which is configured to restrict or reduce horizontal movement of the outer peripheral portion 31 by a certain amount.

The protruding part 640 includes a top portion 642, and a first side wall 641 and a second wall 643 which extend downward along the top portion 642. The first side wall 641 is flush with a side wall of the first recess portion 610. A portion, closer to the protruding part 640, of the upper surface 614 is an example of a supporting portion, which is configured to vertically support the outer peripheral portion 31.

If it is defined that the inner diameter of the first recess portion 610 is d1, the outer diameter of the sealing portion 34 is d4, the inner diameter of the outer peripheral portion 31 is d5, and the outer diameter of the protruding part 640 is d6, the following relationship is satisfied:

$$(d1-d4)>(d5-d6)\geq 0.$$

Figure 11E:
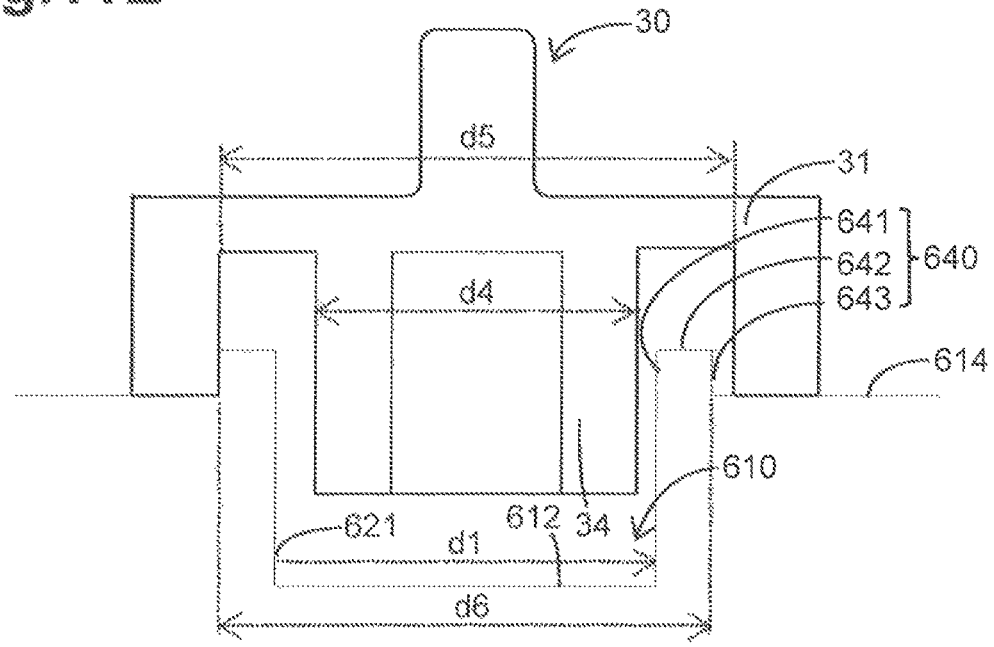
FIG. 11E is a sectional view of the placing portion taken along a line G-G in FIG. 11B, illustrating the sealing member contacting the placing portion.

As depicted in FIG. 11E, "d1−d4", i.e., a difference between the inner diameter of the first recess portion 610 and the outer diameter of the sealing portion 34, may be considered a distance range in which the sealing portion 34 is movable in the horizontal direction within the first recess portion 610. "(d1−d4)>0" may be set to ensure that the sealing portion 34 does not come into contact with the inner wall of the first recess portion 610.

Furthermore, "d5−d6", i.e., a difference between the inner diameter of the outer peripheral portion 31 and the outer diameter of the protruding part 640, may be considered a distance range in which the inner surface of the outer peripheral portion 31 is movable in the horizontal direction within the portion, closer to the protruding part 640, of the upper surface 614. It is desirable that, even when the inner surface of the outer peripheral portion 31 comes into contact with the second side wall 643 of the protruding part 640 in the horizontal direction within the portion, closer to the protruding part 640, of the upper surface 614, i.e., d5 is equal to d6 (d5−d6=0), the sealing portion 34 does not contact the inner wall of the first recess portion 610, i.e., (d1−d4)>0. In other words, when the inner surface of the outer peripheral portion 31 comes into contact with the second side wall 643 in the horizontal direction within the portion, closer to the protruding part 640, of the upper surface 614, there is still a certain distance between the sealing portion 34 and the inner wall of the first recess portion 610. Thus, the difference, d1−d4, between the inner diameter of the first recess portion 610 and the outer diameter of the sealing portion 34 is set to be larger than the difference, d5−d6, between the inner diameter of the outer peripheral portion 31 and the outer diameter (that is, the second side wall 643) of the protruding part 640, i.e., (d1−d4)>(d5−d6)≥0.

According to the ink container of the sixth embodiment, the placing portion includes the protruding part higher than the upper surface, so that the structure of the placing portion may be simple. Further, the protruding part may function as a guide for guiding the sealing portion.

Figure 11F:
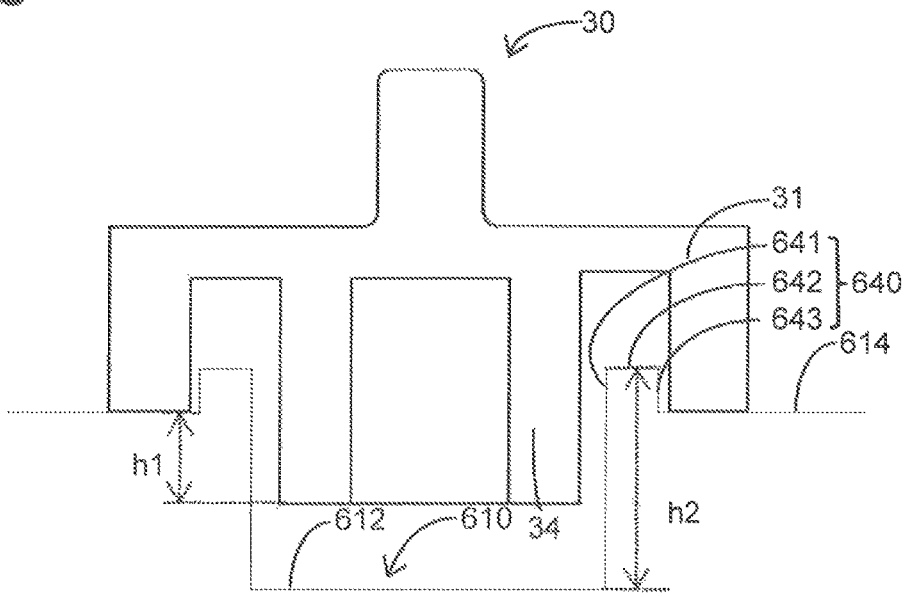
FIG. 11F is another sectional view of the placing portion taken along a line G-G in FIG. 11B, illustrating the sealing member.

Further, as depicted in FIG. 11F, it is preferable that a vertical distance h1 between the bottom portion of the sealing portion 34 and the bottom portion of the outer peripheral portion 31 is smaller than a depth h2 of the first recess portion 610. Thus, contamination of the bottom portion of the sealing portion 34, which is caused by contacting the bottom portion of the sealing portion 34 and the bottom portion of the first recess portion 610, may be prevented. This height relationship is also applicable to other embodiments.

Furthermore, in the sixth embodiment, the protruding part configured to restrict or reduce horizontal movement of the outer peripheral portion may not be continuous, that is, the protruding parts divided into a plurality of portions may be arranged with a space therebetween. Such configuration may provide not only the above-described technical effects but also the design diversity, and enable the user to place the sealing member on the space.

Modifications

Further, in the embodiments, the side wall and the protruding part, which is disposed with a space, may be configured in any shape, as long as it can restrict or reduce horizontal movement of the outer peripheral portion of the sealing member.

Furthermore, the restricting portion may be a plurality of protrusions disposed along a circumferential direction of the first recess portion. At this time, the innermost side of each of the plurality of protrusions toward the first recess portion may serve as a function of restricting movement of the outer peripheral portion of the sealing member, that is, an imaginary surface formed by a circumference passing the innermost side of each of the plurality of protrusions may function as the above-described side wall. Examples will be described.

Figure 12A:
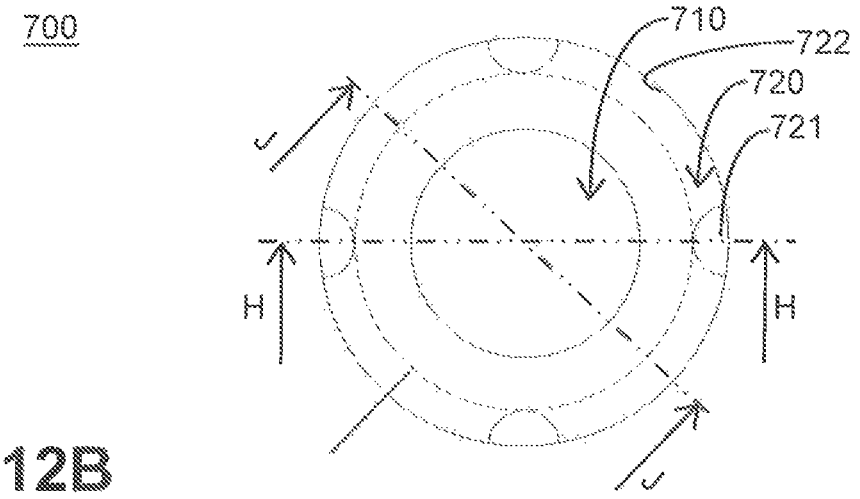
FIG. 12A is a plan view depicting the placing portion in a modification according to one or more aspects of the disclosure.
Figure 12B:
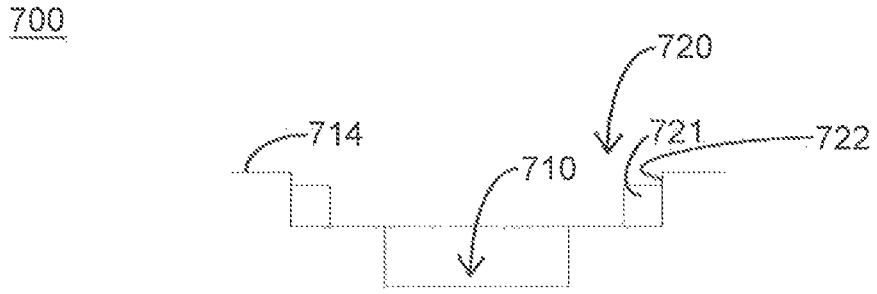
FIG. 12B is a sectional view of the placing portion taken along a line H-H in FIG. 12A.
Figure 12C:
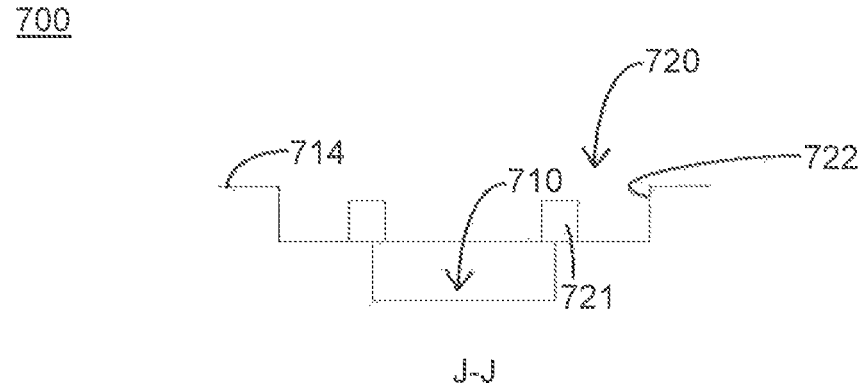
FIG. 12C is a sectional view of the placing portion taken along a line J-J in FIG. 12A.

1) When the plurality of protrusions is disposed on a side wall of a second recess portion, the placing portion in the disclosure may be a placing portion 700 as shown in FIGS. 12A to 12C. The placing portion 700 includes a first recess portion 710 and a second recess portion 720 extending in a circumferential direction of the first recess portion 710. The second recess portion 720 is an example of a positioning member. The first recess portion 710 is configured to accommodate the sealing portion 34 of the sealing member 30 and not to contact the sealing portion 34 while accommodating the sealing portion 34. The first recess portion 710 may be configured to be a cylindrical recess. A side wall 722 of the second recess portion 720 includes four protrusions 721. The innermost side (i.e., an imaginary surface 760 passing the innermost side of each of the four protrusions 721, as indicated by a dotted line in FIG. 12A) of each of the four protrusions 721 may serve as a function of restricting or reducing horizontal movement of the outer peripheral portion 31 of the sealing member 30. Thus, the sealing portion 34 may not contact the first recess portion 710, so that the first recess portion 710 may not be contaminated with the ink adhering to the sealing portion 34.

Figure 13A:
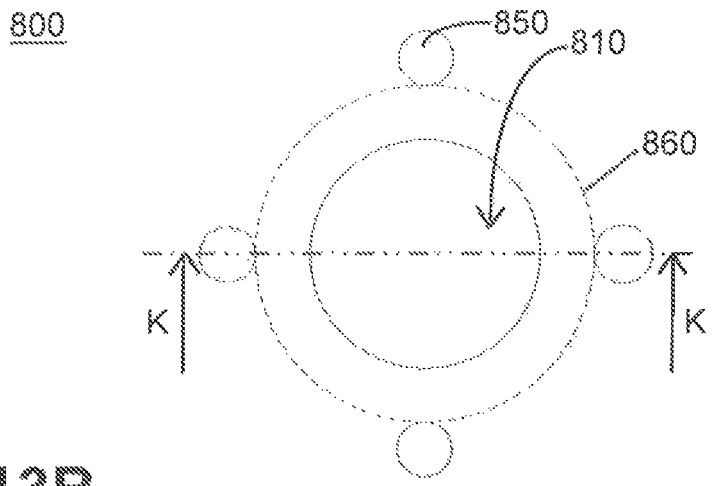
FIG. 13A is a plan view depicting the placing portion in another modification according to one or more aspects of the disclosure.
Figure 13B:
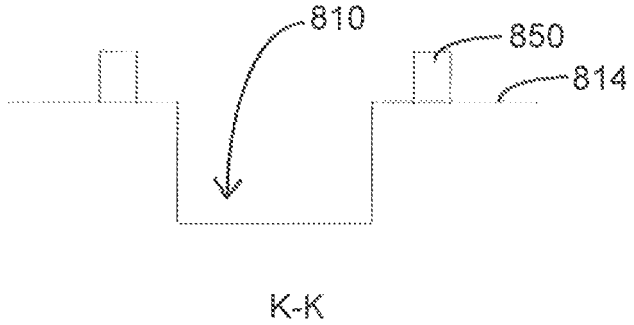
FIG. 13B is a sectional view of the placing portion taken along a line K-K in FIG. 13A.

2) When the plurality of protrusions protrude upward from an upper surface of the ink containing portion, the placing portion in the disclosure may be a placing portion 800 as shown in FIGS. 13A and 13B. The placing portion 800 includes a first recess portion 810 and four protruding columns 850 extending in a circumferential direction of the first recess portion 810. The protruding column 850 is an example of a positioning member. The first recess portion 810 is configured to accommodate the sealing portion 34 of the sealing member 30 and not to contact the sealing portion 34 while accommodating the sealing portion 34. The first recess portion 810 may be configured to be a cylindrical recess. Each of the four protruding columns 810 protrudes upward from an upper surface 814. The innermost side (i.e., an imaginary surface 860 passing the innermost side of each of the four protruding columns 850, as indicated by a dotted line in FIG. 13A) of each of the four protruding columns 850 may serve as a function of restricting or reducing horizontal movement of the outer peripheral portion 31 of the sealing member 30. Thus, the sealing portion 34 may not contact the first recess portion 810, so that the first recess portion 810 may not be contaminated with the ink adhering to the sealing portion 34.

The number of protrusions or protruding columns is not limited to four, and may be any number as desired. As long as an imaginary surface can be formed, the number of protrusions or protruding columns may be set to three or more.

Further, as depicted in the plan view of each of the placing portions, the cross section of each of the placing portions in the horizontal direction may be circular.

Furthermore, in the figures of the disclosure, a distance between an upper surface of the main body portion 36 to a bottom end of the outer peripheral portion 31 is shorter than a distance between an upper surface of the main body portion 36 to a bottom end of the sealing portion 34, that is, a vertical length of the outer peripheral portion 31 is shorter than a vertical length of the sealing portion 34.

Furthermore, in the above-described first to sixth embodiments, the second recess portion includes the bottom portion and the side wall, and the bottom portion of the second recess portion is lower than the upper surface of the placing portion and the side wall of the second recess portion extends upward from the outermost end of the bottom portion to the upper surface of the placing portion. However, the bottom portion of the second recess portion may be the same height as the upper surface of the placing portion and the side wall of the second recess portion may be higher than the upper surface of the placing portion, as long as the side wall of the second recess portion can position the outer peripheral portion in the horizontal direction.

Furthermore, the disclosure also provides an inkjet printer including the above-described ink container. According to the inkjet printer including the ink container of the disclosure, the placing portion does not come into contact with the sealing portion of the sealing member, so that contamination of the side wall of the placing portion with the ink adhering to the sealing portion may be prevented. Further, horizontal movement of the sealing member is restricted or reduced by the restricting portion, so that it may be easier to place the sealing member on the placing portion. Furthermore, the bottom portion of the second recess portion supports the outer peripheral portion, and the second recess portion may restrict or reduce horizontal movement of the sealing member.

While the disclosure has been described in detail with reference to the specific embodiments thereof, these are merely examples, and various changes, arrangements and modifications may be applied therein without departing from the spirit and scope of the disclosure.

What is claimed is:

1. An ink container for an inkjet printer, the inkjet printer including a printer body, the ink container including an ink containing portion configured to contain ink to be supplied to the printer body, the ink containing portion including:

an upper surface including a placing portion;

a refill port which is disposed on the upper surface and through which ink is poured, the placing portion being disposed corresponding to the refill port; and a sealing member including a sealing portion configured to seal the refill port and a downward facing surface facing downward, the downward facing surface including an upper downward facing surface and a lower downward facing surface, wherein the placing portion further includes a first recess portion configured to receive the sealing member and a supporting portion configured to contact the upper downward facing surface of the sealing member to vertically support the sealing member such that the lower downward facing surface of the sealing member does not contact the first recess portion, wherein the placing portion further includes a restricting portion configured to restrict a horizontal movement of the sealing member when the sealing member is placed on the placing portion, and wherein the sealing member includes the outermost wall, the restricting portion is located inside the outermost wall, and an upper surface of the restricting portion is positioned higher than a bottom surface of the outermost wall.

2. The ink container according to claim 1, wherein the first recess portion has a vertical surface and a bottom surface, and the lower downward facing surface of the sealing member does not contact the bottom surface of the first recess portion.

3. The ink container according to claim 2, wherein the sealing portion does not contact the bottom surface of the first recess portion.

4. The ink container according to claim 1, wherein the first recess portion has a vertical surface and a bottom surface, and the sealing portion does not contact the bottom surface of the first recess portion.

5. The ink container according to claim 1, wherein the upper downward facing surface is positioned outside the lower downward facing surface in the radial direction of the sealing member.

6. The ink container according to claim 1, wherein the upper downward facing surface is positioned on the outermost side of the sealing member.

7. The ink container according to claim 1, wherein the upper downward facing surface has a hollow circular shape.

8. The ink container according to claim 1, wherein the supporting portion is positioned outside the first recess portion.

9. The ink container according to claim 1, wherein the restricting portion is positioned higher than the supporting portion.

10. The ink container according to claim 1, wherein the sealing member further includes a protruding portion protruding from the upper surface of the sealing member.

11. The ink container according to claim 1, wherein when an inner diameter of the first recess portion is d1 and an outer diameter of the sealing portion is d4, the following relationship is satisfied: d1>d4.

* * * * *